US009248670B2

(12) United States Patent
Fujihara et al.

(10) Patent No.: US 9,248,670 B2
(45) Date of Patent: Feb. 2, 2016

(54) CONVEYOR DEVICE AND INKJET RECORDING APPARATUS

(71) Applicant: KYOCERA Document Solutions Inc., Osaka (JP)

(72) Inventors: Masami Fujihara, Osaka (JP); Takeshi Watanabe, Osaka (JP); Hidenori Takenaka, Osaka (JP); Tomohisa Soda, Osaka (JP); Jumpei Hobo, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/674,788

(22) Filed: Mar. 31, 2015

(65) Prior Publication Data

US 2015/0273880 A1 Oct. 1, 2015

(30) Foreign Application Priority Data

Apr. 1, 2014 (JP) ..... 2014-075591

(51) Int. Cl.
*B41J 2/01* (2006.01)
*B41J 11/00* (2006.01)

(52) U.S. Cl.
CPC ..... *B41J 11/007* (2013.01); *B41J 11/0045* (2013.01); *B41J 11/0085* (2013.01)

(58) Field of Classification Search
CPC ..... B41J 11/0085; B41J 11/007; B41J 2/22; B41J 25/312; B41J 11/02; B41J 11/0045
USPC ..... 347/104
See application file for complete search history.

(56) References Cited

U.S. PATENT DOCUMENTS

| | | | | |
|---|---|---|---|---|
| 5,712,672 | A * | 1/1998 | Gooray et al. | 347/102 |
| 2004/0174421 | A1* | 9/2004 | Tsuji | 347/104 |
| 2005/0200680 | A1* | 9/2005 | Uchida | B41J 11/0065 347/104 |
| 2010/0079530 | A1* | 4/2010 | Kachi | 347/16 |
| 2010/0084803 | A1* | 4/2010 | Akihiro | B41J 11/007 271/3.22 |
| 2011/0057380 | A1* | 3/2011 | Maeyama | B41J 11/0025 271/11 |
| 2013/0229474 | A1* | 9/2013 | Yamamoto | B41J 11/0085 347/104 |

FOREIGN PATENT DOCUMENTS

JP 2011-183746 A 9/2011

* cited by examiner

*Primary Examiner* — Matthew Luu
*Assistant Examiner* — Patrick King
(74) *Attorney, Agent, or Firm* — Studebaker & Brackett PC

(57) ABSTRACT

A conveyor device is disposed opposite to a recording head. The conveyor device includes a conveyor belt and a suction section. The suction section sucks on a recording medium through the conveyor belt. The suction section includes an air flow chamber and a guide member. The air flow chamber is disposed opposite to one surface of the conveyor belt, and negative pressure for sucking the recording medium onto another surface of the conveyor belt is created in the air flow chamber. The guide member covers the air flow chamber and supports the conveyor belt. The air flow chamber includes a partition wall dividing the air flow chamber into first and second spaces. The first space includes a third space overlapping with the recording head with the conveyor belt and the guide member therebetween. Pressure in the first space is less negative than pressure in the second space.

14 Claims, 8 Drawing Sheets

CONVEYOR DEVICE AND INKJET RECORDING APPARATUS

INCORPORATION BY REFERENCE

The present application claims priority under 35 U.S.C. §119 to Japanese Patent Application No. 2014-075591 filed Apr. 1, 2014. The contents of this application are incorporated herein by reference in their entirety.

BACKGROUND

The present disclosure relates to a conveyor device for conveying a recording medium and to an inkjet recording apparatus.

In general, a printer (inkjet recording apparatus) includes a conveyor device for conveying paper (an example of recording media). Contact, rubbing, and friction between paper and a paper feed roller, a conveyance roller, or a paper guide, for example, in the conveyor device result in fibers and a filler coming off the paper, generating paper dust. The paper dust adheres to the paper and is conveyed to a location right under a recording head of the printer.

Some of the paper dust on the paper being conveyed may attach to a cylindrical rubber part of the conveyance roller and move from the rubber part to another sheet of paper being conveyed next by the conveyance roller. As a result, a large amount of paper dust may be accumulated on the paper and conveyed to the location right under the recording head.

Air currents (air flows) are generated in the printer and stir up the paper dust. As a result, the contamination by the paper dust is expanded in the printer. Some printers convey paper by suction holding. Such printers have a conveyor belt with a plurality of suction holes. Air above the conveyor belt is drawn through the suction holes, and thus paper is held onto the conveyor belt by suction. The drawing of air through the suction holes generates an air flow in the printer from the top of the conveyor belt to the bottom of the conveyor belt through the suction holes. Conveyance of paper also generates an air flow in the paper conveyance direction. Thus, there are usually strong air flows in the space between the conveyor belt and the recording head, and paper is subjected to the air flows while being conveyed under the recording head. As a result, paper dust is likely to be stirred up (blown off) from paper by the air flows under the recording head, and thus the contamination by the paper dust is expanded in the printer.

In general, paper dust can cause the following problem in the printer. The recording head is disposed right above the conveyor belt with a space enough for paper to pass therethrough. Therefore, the recording head is close to the conveyor belt. Paper dust may be conveyed with paper and attach to a nozzle of the recording head as the paper passes through the space under the recording head. As a result, the nozzle is likely to be clogged to prevent ink ejection, and an image formed on the paper may have a defect.

In view of the problem, some inkjet printers include a paper dust remover. The paper dust remover has a housing, a static elimination brush that eliminates static electricity from paper, and an air blower that blows air toward the paper after the static elimination. The housing is located upstream of a printing section. The static elimination brush and the air blower are disposed in the housing. Paper dust that has departed from paper therefore drifts within the housing located upstream of the printing section, prevented from attaching to a recording head.

SUMMARY

A conveyor device according to a first aspect of the present disclosure is disposed opposite to a recording head. The conveyor device includes a conveyor belt and a suction section. The conveyor belt conveys a recording medium. The suction section sucks on the recording medium through the conveyor belt. The suction section includes an air flow chamber and a guide member. The air flow chamber is disposed opposite to one surface of the conveyor belt, and negative pressure for sucking the recording medium onto another surface of the conveyor belt is created in the air flow chamber. The guide member covers the air flow chamber and supports the recording medium via the conveyor belt. The air flow chamber includes a partition wall. The partition wall divides the air flow chamber into at least one first space and at least one second space. The first space includes at least one third space. The third space overlaps with the recording head with the conveyor belt and the guide member therebetween. Pressure in the first space is less negative than pressure in the second space.

An inkjet recording apparatus according to a second aspect of the present disclosure includes the conveyor device according to the first aspect of the present disclosure and the recording head. The recording head includes an inkjet head that ejects ink.

DETAILED DESCRIPTION

Figure 1:
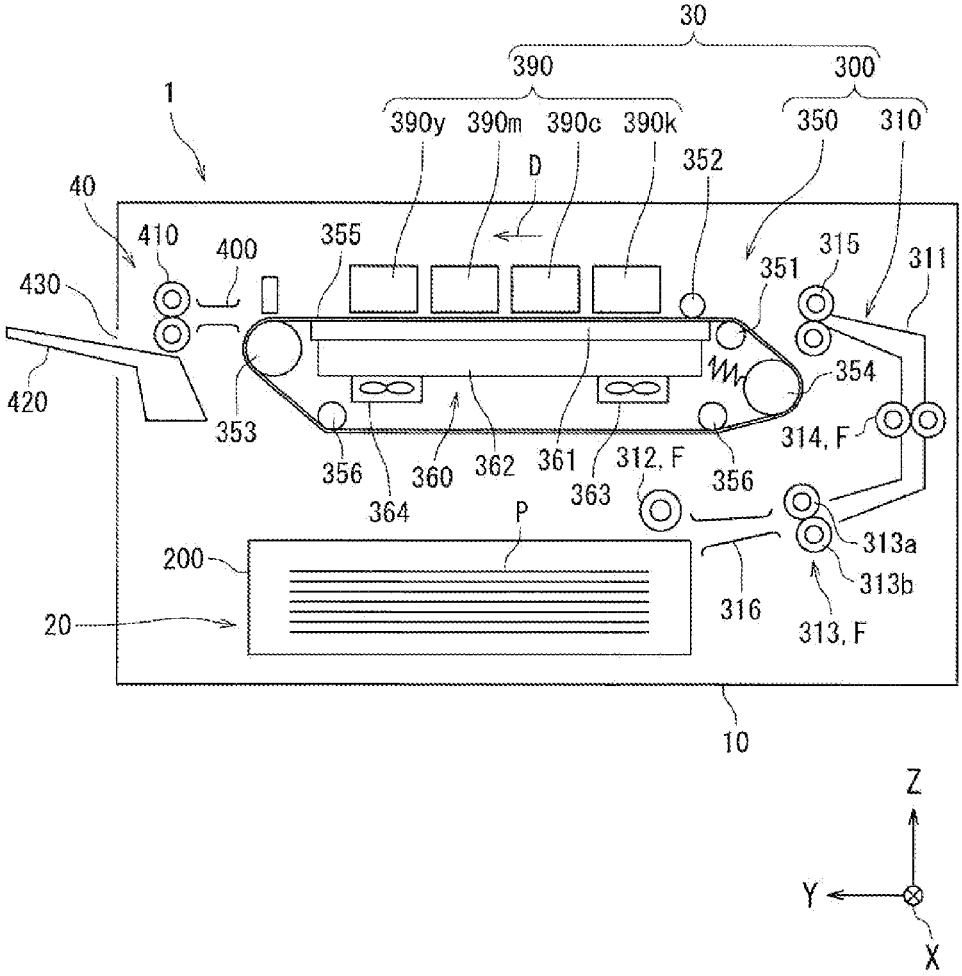
FIG. 1 is a diagram illustrating configuration of an inkjet recording apparatus including a conveyor device according to a first embodiment of the present disclosure.

Hereinafter, embodiments of the present disclosure will be described with reference to the accompanying drawings. In the figures of the accompanying drawings, the like reference numerals refer to similar elements, and explanation thereof is not repeated.

First Embodiment

Basic Principle

The basic principle of a conveyor device 300 according to a first embodiment of the present disclosure will be described with reference to FIGS. 1-3. FIG. 1 is a diagram illustrating schematic configuration of an inkjet recording apparatus 1. The inkjet recording apparatus 1 includes the conveyor device 300 and a recording head 390. The conveyor device 300 is disposed opposite to the recording head 390.

The conveyor device 300 includes a conveyor belt 355 and a suction section 360. The conveyor belt 355 conveys a recording medium P. The suction section 360 sucks on the recording medium P through the conveyor belt 355. The suction section 360 includes an air flow chamber 362 and a guide member 361. The air flow chamber 362 is disposed opposite to one surface of the conveyor belt 355. Negative pressure for sucking the recording medium onto the other surface of the conveyor belt 355 is created in the air flow chamber 362. The guide member 361 covers the air flow chamber 362 and supports the recording medium via the conveyor belt 355.

Figure 2:
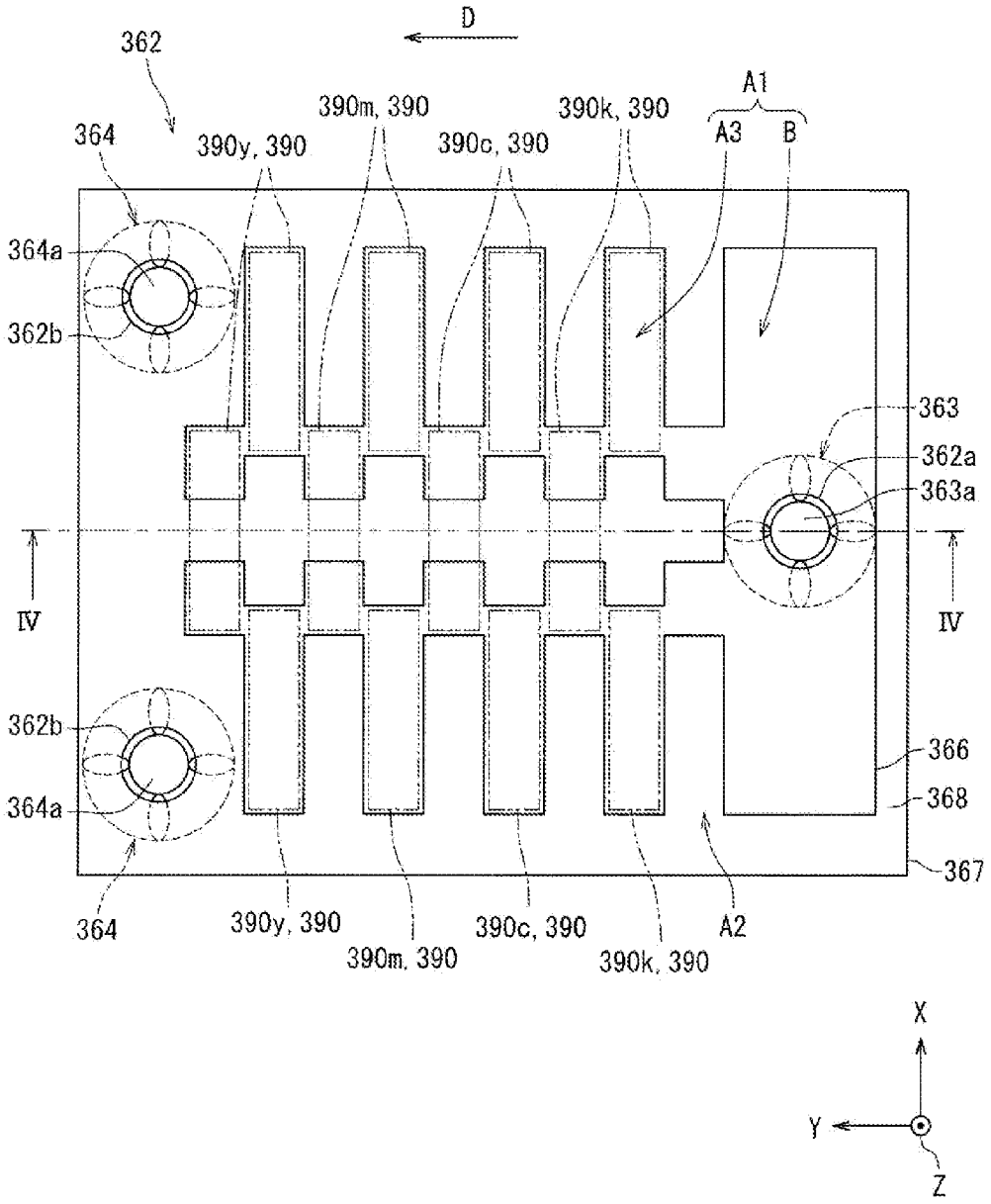
FIG. 2 is a plan view of an air flow chamber of the conveyor device according to the first embodiment of the present disclosure.
Figure 3:
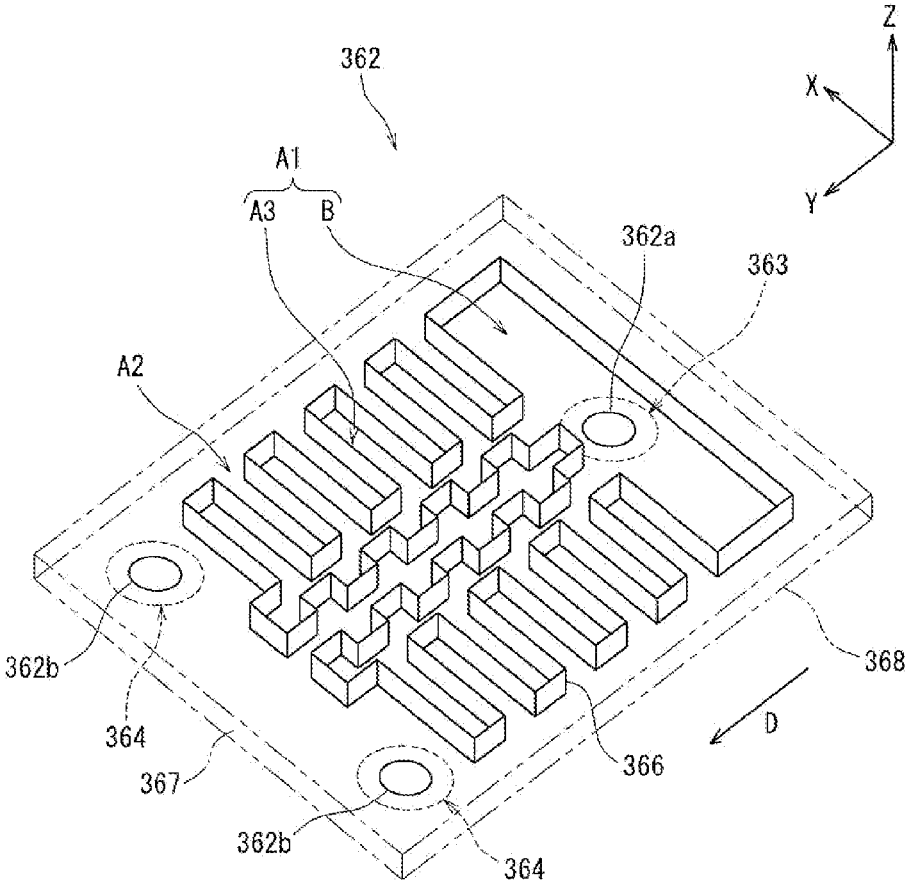
FIG. 3 is a perspective view of the air flow chamber according to the first embodiment of the present disclosure.

FIGS. 2 and 3 illustrate the air flow chamber 362. The air flow chamber 362 includes a partition wall 366. The partition wall 366 divides the air flow chamber 362 into a first space A1 and a second space A2. The first space A1 includes a third space A3. The third space A3 overlaps with the recording head 390 with the conveyor belt 355 and the guide member 361 therebetween. The pressure in the first space A1 is less negative than the pressure in the second space A2.

According to the first embodiment, the air flow chamber 362 is divided into the first space A1 and the second space A2, and the pressure in the first space A1 is less negative than the pressure in the second space A2. Accordingly, the flow of air is restricted right under the recording head 390 overlapping with the third space A3 included in the first space A1. As a result, paper dust can be prevented from being stirred up right under the recording head 390 and from attaching to the recording head 390 with the simple configuration.

It should be noted here that negative pressure refers to pressure lower than reference pressure. The reference pressure referred to in the present specification is atmospheric pressure. Negative pressure $P_N$ is an absolute value of ($P_A$−$P_R$), wherein "$P_A$" represents the absolute pressure and "$P_R$" represents the reference pressure ($P_N$=|$P_A$−$P_R$|). The absolute pressure is pressure based on the absolute vacuum of 0.

[Configuration of Inkjet Recording Apparatus 1]

The inkjet recording apparatus 1 will be described with reference to FIG. 1. The inkjet recording apparatus 1 includes a housing 10, a paper feed section 20 disposed in a lower location in the housing 10, an ink-jet image forming section 30, and a paper ejecting section 40.

The paper feed section 20 includes a paper feed cassette 200. The paper feed cassette 200 is detachably mounted in the housing 10. A plurality of sheets of recording medium P are stacked and loaded in the paper feed cassette 200. The recording medium P is paper such as plain paper, recycled paper, thin paper, or thick paper, for example.

The image forming section 30 includes the conveyor device 300 and the recording head 390. The conveyor device 300 includes a first paper conveyance section 310 and a second paper conveyance section 350 disposed opposite to the recording head 390. The second paper conveyance section 350 is located between the first paper conveyance section 310 and the paper ejecting section 40. The image forming section 30 may include a drier (not shown). The drier dries ink droplets ejected onto the recording medium P.

The first paper conveyance section 310 has a substantially C-shaped paper conveyance path 311. The first paper conveyance section 310 includes a paper feed roller 312 disposed above one end of the paper feed cassette 200, a pair of first conveyance rollers 313 disposed at an inlet of the paper conveyance path 311, a pair of second conveyance rollers 314 disposed at a midway portion of the paper conveyance path 311, a pair of registration rollers 315 disposed at an outlet of the paper conveyance path 311, and a guide plate 316.

An X axis in FIG. 1 is parallel to a direction perpendicular to a conveyance direction D of the recording medium P. A Y axis is parallel to the conveyance direction D of the recording medium P on the guide member 361. A Z axis is parallel to a direction perpendicular to the guide member 361. In the first embodiment, the Z axis is a vertical direction. The X axis, the Y axis, and the Z axis are perpendicular to one another.

The guide plate 316 is disposed between the paper feed roller 312 and the pair of first conveyance rollers 313. The paper feed roller 312 takes out the recording medium P in the paper feed cassette 200 sheet by sheet. The guide plate 316 guides the recording medium P taken out by the paper feed roller 312 to the pair of first conveyance rollers 313.

The pair of first conveyance rollers 313 catches and conveys the recording medium P guided thereto by the guide plate 316 toward the paper conveyance path 311. Specifically, the pair of first conveyance rollers 313 includes a feed roller 313*a* and a retard roller 313*b*. The feed roller 313*a* and the retard roller 313*b* are opposed to each other and pressed against each other. The feed roller 313*a* rotates to convey the recording medium P in the conveyance direction D. The retard roller 313*b* is driven by the feed roller 313*a* to rotate when receiving one sheet of recording medium P.

Upon receiving a plurality of sheets of recording medium P at the same time, on the other hand, the retard roller 313*b* stops or rotates in a direction opposite to a direction for conveying the recording medium P to separate a sheet(s) of recording medium P from a sheet of recording medium P in contact with the feed roller 313*a*. As a result, one sheet of recording medium P is fed by the feed roller 313*a*.

The pair of second conveyance rollers 314 catches and conveys the recording medium P conveyed thereto by the pair of first conveyance rollers 313 toward the pair of registration rollers 315. The pair of registration rollers 315 performs skew correction on the recording medium P that has arrived and stopped at the pair of registration rollers 315. The pair of registration rollers 315 temporarily holds the recording medium P to synchronize the conveyance of the paper P and printing, and then conveys the recording medium P to the second paper conveyance section 350 in a timed relationship with the printing.

The second paper conveyance section 350 includes a speed sensing roller 351, a placing roller 352, a drive roller 353, a tension roller 354, a pair of guide rollers 356, the endless conveyor belt 355, and the suction section 360. The conveyor belt 355 is wound around the speed sensing roller 351, the drive roller 353, the tension roller 354, and the pair of guide rollers 356 in a tensioned manner. In the present specification, a surface of the conveyor belt 355 on which the recording medium P is placed is referred to as conveyance surface, and a surface opposite to the conveyance surface is referred to as conveyance back surface. Rotation axes of the rollers such as the drive roller 353 are parallel to the X axis. The conveyor belt 355 has a plurality of suction holes (not shown). Each of the suction holes penetrates the conveyor belt 355 from the conveyance surface through to the conveyance back surface.

The speed sensing roller 351 is located upstream of the guide member 361 in terms of the conveyance direction D of the recording medium P. The speed sensing roller 351 includes a pulse plate (not shown). The speed sensing roller 351 rotates in contact with the conveyor belt 355. The rotational speed of the conveyor belt 355 is sensed by measuring the rotational speed of the pulse plate rotating integrally with the speed sensing roller 351. The speed sensing roller 351 restricts influence of meandering correction on the conveyor belt 355 under the recording head 390.

The placing roller 352 is located at an upstream end of the guide member 361 in terms of the conveyance direction D with the conveyor belt 355 therebetween. The placing roller 352 conveys the recording medium P in the conveyance direction D while pressing the recording medium P against the conveyor belt 355 and the guide member 361. The placing roller 352 reduces curl of the recording medium P so that the suction section 360 can suck on the recording medium P entirely and uniformly. As a result, the contact between the recording medium P and the conveyor belt 355 is made closer. It is preferable that the moment of inertia of the placing roller 352 is low and the placing roller 352 is light in order to reduce impact vibrations on the placing roller 352 when the recording medium P comes under the placing roller 352.

For example, the placing roller 352 is formed from an aluminum hollow pipe or a hollow pipe including a plurality of ribs. Where the surface of the placing roller 352 is formed from aluminum, the surface is preferably subjected to alumite treatment in order to reduce abrasion of the surface of the placing roller 352. The alumite treatment refers to a surface treatment involving anodizing the aluminum surface through electrolysis of water in a solution mainly containing a strong acid and thereby forming a coating. The alumite treatment imparts electrical insulation to the placing roller 352. However, the surface of the placing roller 352 does not need to be subjected to the alumite treatment where the placing roller 352 needs to be electrically conductive.

The speed of conveyance of the recording medium P by the pair of registration rollers 315 may be different from the speed of conveyance of the recording medium P by the conveyor belt 355. The conveyance speed difference can be overcome by applying pressing force from the placing roller 352 to the recording medium P on the conveyor belt 355 and thus causing flexing of the recording medium P between the pair of registration rollers 315 and the placing roller 352.

The drive roller 353 is disposed in a spaced relationship to the speed sensing roller 351 in terms of the conveyance direction D of the recording medium P. The speed sensing roller 351 and the drive roller 353 maintain the conveyor belt 355 on the guide member 361 flat. The drive roller 353 is in close contact with the conveyor belt 355 because of frictional force.

Where the conveyor belt 355 is made from a resin such as polyimide (PI), polyamide-imide (PAI), polyvinylidene fluoride (PVDF), or polycarbonate (PC), for example, it is preferable to wind a rubbery material such as ethylene propylene diene monomer (EPDM) rubber, polyurethane resin, or nitrile rubber (NBR) around the surface of the drive roller 353. Where the image forming section 30 forms an image on the recording medium P using an aqueous ink, in particular, it is preferable to wind ethylene propylene diene monomer (EPDM) rubber around the drive roller 353 in order to prevent swelling of the rubbery material around the drive roller 353.

Where the conveyor belt 355 includes a rubbery material such as ethylene propylene diene monomer (EPDM) rubber, the surface of the drive roller 353 may be made from a metal. Where the surface of the drive roller 353 is made from aluminum, the surface of the drive roller 353 is preferably subjected to alumite treatment in order to reduce abrasion of the surface of the drive roller 353. The alumite treatment imparts electrical insulation to the drive roller 353. Where the drive roller 353 is in electrical communication with the conveyor belt 355, reduction in the accuracy of ink landing is restricted by electrically grounding the conveyor belt 355. In this case, the rubbery material included in the conveyor belt 355 is given electrical conductivity.

The drive roller 353 is driven by a motor (not shown) to rotate and cause the conveyor belt 355 to rotate counterclockwise. If the speed of the conveyor belt 355 is non-constant, non-constant speed correction control is exercised on the conveyor belt 355. The non-constant speed correction control is exercised to correct the non-constant rotation speed of the conveyor belt 355 so that the rotation speed of the conveyor belt 355 is constant. It is preferable that the moment of inertia of the drive roller 353 is low and the drive roller 353 is light for the non-constant speed correction control.

For example, the drive roller 353 is made from an aluminum hollow pipe or a hollow pipe including a plurality of ribs. In the absence of the non-constant speed correction control, on the other hand, it is preferable that the drive roller 353 is heavy in order to stabilize the rotation of the drive roller 353 by the flywheel effect due to the inertia of the drive roller 353. In this case, the drive roller 353 is made from a solid metal.

The tension roller 354 is disposed at a section of the conveyor belt 355 that is located upstream of the guide member 361. The tension roller 354 tensions the conveyor belt 355 in order to prevent flexing of the conveyor belt 355. Shifting one end of the tension roller 354 enables automatic correction of meandering of the conveyor belt 355.

The conveyor belt 355 conveys the recording medium P sucked on the conveyor belt 355. The conveyor belt 355 is preferably made from polyamide-imide (PAI) or polyimide (PI), for example. Such materials prevent the conveyor belt 355 from having uneven thickness. The pair of guide rollers 356 is disposed under the suction section 360.

The pair of guide rollers 356 is fixed, maintaining a space defined by the internal peripheral surface (conveyance back surface) of the conveyor belt 355. Of the pair of guide rollers 356, a guide roller 356 that is closer to the drive roller 353 maintains the degree to which the conveyor belt 355 is wound around the drive roller 353. Of the pair of guide rollers 356, the other guide roller 356 that is closer to the tension roller 354 maintains the degree to which the conveyor belt 355 is wound around the tension roller 354 for stable correction of meandering of the conveyor belt 355.

The suction section 360 is disposed at the conveyance back surface of the conveyor belt 355 and opposite to the recording head 390 with the conveyor belt 355 therebetween. The suction section 360 includes the guide member 361, the air flow chamber 362, at least one first sucking device 363, and at least one second sucking device 364. The air flow chamber 362 has a hollow box-like shape opened at the top. That is, an opening is formed in the top of the air flow chamber 362. The guide member 361 covers (blocks) the top opening of the air flow chamber 362. The guide member 361 supports the recording medium P via the conveyor belt 355.

Each of the first sucking device 363 and the second sucking device 364 is in communication with the air flow chamber 362 and draws the air in the air flow chamber 362 to create negative pressure within the air flow chamber 362. As a result, the recording medium P is sucked toward the top of the air flow chamber 362 through the conveyor belt 355 and the guide member 361. The suction force exerted by the first sucking device 363 is smaller than the suction force exerted by the second sucking device 364. The air flow chamber 362 functions as a decompression chamber.

The paper ejecting section 40 includes a conveyance guide 400, a pair of ejection rollers 410, and an exit tray 420. The conveyance guide 400 is located downstream of the second paper conveyance section 350 in terms of the conveyance direction D of the recording medium P. The exit tray 420 is fixed to the housing 10 and projected outward from an exit port 430 formed in the housing 10.

The conveyance guide 400 guides the recording medium P being conveyed from the conveyor belt 355 to the pair of ejection rollers 410. The recording medium P that has passed through the conveyance guide 400 is conveyed by the pair of ejection rollers 410 to the exit port 430 and ejected onto the exit tray 420 through the exit port 430.

[Configuration of Recording Head 390]

The configuration of the recording head 390 will be described in detail with reference to FIG. 2. The recording head 390 includes one or more inkjet heads 390*k*, one or more inkjet heads 390*c*, one or more inkjet heads 390*m*, and one or more inkjet heads 390*y*. Each of the inkjet heads 390*k*, 390*c*, 390*m*, and 390*y* ejects ink.

In the first embodiment, the recording head 390 includes three inkjet heads 390*k* (may be referred to as a set of inkjet heads 390*k*), three inkjet heads 390*c* (may be referred to as a set of inkjet heads 390*c*), three inkjet heads 390*m* (may be referred to as a set of inkjet heads 390*m*), and three inkjet heads 390*y* (may be referred to as a set of inkjet heads 390*y*).

The sets of inkjet heads 390*k*, 390*c*, 390*m*, and 390*y* are aligned from an upstream location to a downstream location in terms of the conveyance direction D of the recording medium P. The three inkjet heads 390*k* are in a staggered arrangement in a width direction of the conveyor belt 355 (see FIG. 1). The three inkjet heads 390*c*, the three inkjet heads 390*m*, and the three inkjet heads 390*y* are in the same arrangement as the three inkjet heads 390*k*.

Each of the inkjet heads 390*k*, the inkjet heads 390*c*, the inkjet heads 390*m*, and the inkjet heads 390*y* is a linehead and includes a plurality of nozzles (not shown). The nozzles are formed in a nozzle surface of each of the inkjet heads 390*k*, 390*c*, 390*m*, and 390*y*. The nozzle surfaces of the inkjet heads 390*k* face the guide member 361. The nozzle surfaces of the inkjet heads 390*c*, 390*m*, and 390*y* also face the guide member 361. The recording head 390 is of a line type. The inkjet heads 390*k*, 390*c*, 390*m*, and 390*y* are elongated in the width direction of the conveyor belt 355 (see FIG. 1).

The nozzles of each inkjet head 390*k* are in communication with a pressure chamber (not shown) formed in each inkjet head 390*k*. The pressure chamber is in communication with an ink chamber (not shown) formed in each inkjet head 390*k*. The ink chamber is communicably connected with a black (K) ink tank (not shown) via an ink supplying tube (not shown). Accordingly, a black (K) ink is ejected through the nozzles of the inkjet heads 390*k*.

The inkjet heads 390*c*, 390*m*, and 390*y* have the same configuration as the inkjet heads 390*k*. Note that the inkjet heads 390*c* are communicably connected with a cyan (C) ink tank (not shown) and eject cyan (C) ink. Likewise, the inkjet heads 390*m* are communicably connected with a magenta (M) ink tank (not shown) and eject magenta (M) ink. The inkjet heads 390*y* are communicably connected with a yellow (Y) ink tank (not shown) and eject yellow (Y) ink.

[Suction Section 360]

The suction section 360 will be described with reference to FIGS. 1-4. As described above, the suction section 360 includes the guide member 361, the air flow chamber 362, the first sucking device 363, and the second sucking device 364.

Figure 4:
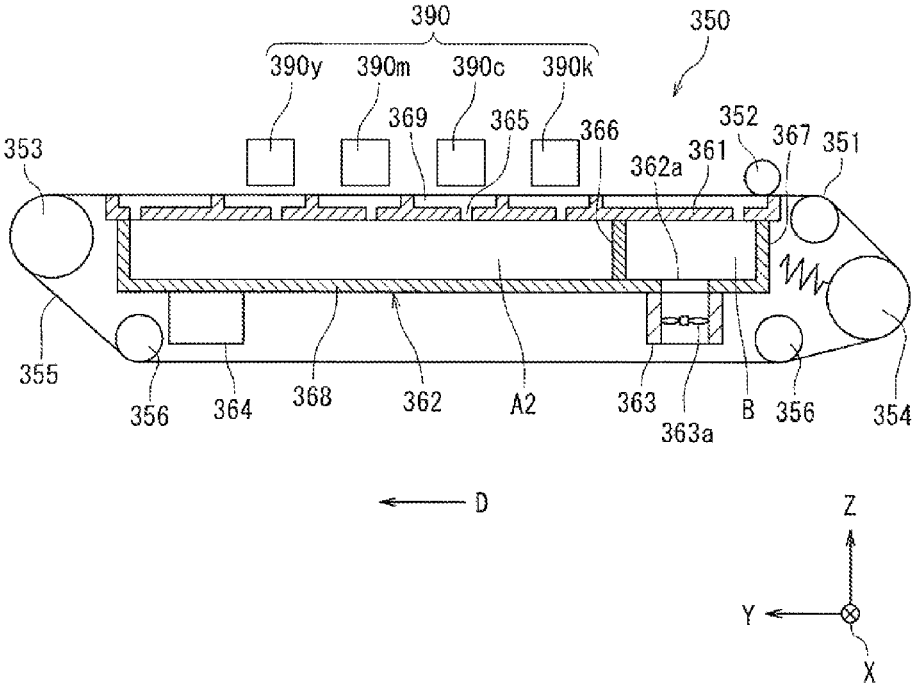
FIG. 4 is a cross sectional view taken along line IV-IV of FIG. 2.

First, the guide member 361 will be described in detail. FIG. 4 is a cross sectional view taken along line IV-IV of FIG. 2. A plurality of grooves 369 are formed in the guide member 361. A through hole 365 is formed in the bottom of each of the grooves 369. The through hole 365 penetrates the guide member 361. Thus, the grooves 369 are in communication with the air flow chamber 362.

Next, the air flow chamber 362 will be described in detail. As shown in FIGS. 2 and 3, the air flow chamber 362 has a rectangular shape in a plan view. The air flow chamber 362 has a box-like shape including the partition wall 366, an outer wall 367, and a bottom wall 368. The outer wall 367 is stood from peripheral edges of the rectangular bottom wall 368. The air flow chamber 362 has the first space A1 and the second space A2.

The first space A1 is enclosed by the partition wall 366. The partition wall 366 is a closed wall and divides the air flow chamber 362 into spaces in such a manner that the third space A3 overlaps with the inkjet heads 390*k*, 390*c*, 390*m*, and 390*y* with the conveyor belt 355 and the guide member 361 therebetween. The first space A1 includes the third space A3 and an intervening space B. The third space A3 overlaps with the inkjet heads 390*k*, 390*c*, 390*m*, and 390*y* with the conveyor belt 355 and the guide member 361 therebetween. The intervening space B is located upstream of the third space A3 in terms of the conveyance direction D. The second space A2 is located between the outer wall 367 and the partition wall 366. Dividing the air flow chamber 362 into the first space A1 and the second space A2 by the partition wall 366 allows creation of a pressure difference between the first space A1 and the second space A2.

One opening 362*a* and two openings 362*b* are formed in the bottom wall 368. The opening 362*a* is formed within the partition wall 366 and at an upstream end of the bottom wall 368 in terms of the conveyance direction D. The opening 362*a* is located under the intervening space B and on a center line of the bottom wall 368 in the conveyance direction D. The openings 362*b* are formed outside of the partition wall 366 and at a downstream end of the bottom wall 368 in terms of the conveyance direction D. The two openings 362*b* are located under the second space A2 and arranged symmetrically with respect to the center line of the bottom wall 368 in the conveyance direction D. The opening 362*a* and the openings 362*b* have a circular shape in the first embodiment. Alternatively, the opening 362*a* and the openings 362*b* may have another shape such as a polygonal shape.

Next, the first sucking device 363 and the second sucking device 364 will be described in detail. As shown in FIG. 2, the first sucking device 363 is disposed under the opening 362*a*. Two second sucking devices 364 are provided corresponding to the two openings 362*b*. Each of the second sucking devices 364 is disposed under the corresponding opening 362*b*.

The first sucking device 363 includes a fan 363*a* and is rotated by a motor (not shown). Each of the second sucking devices 364 includes a fan 364*a* and is rotated by a motor (not shown). The fan 363*a* and the fans 364*a* are not shown in FIG. 3 in the interest of ease of illustration.

Next, creation of negative pressure will be described. The first sucking device 363 creates negative pressure in the first space A1. Specifically, the intervening space B is continuous from the third space A3 and located between the third space A3 and the opening 362*a*. The first sucking device 363 is disposed under the opening 362*a*. Accordingly, the first sucking device 363 draws the air in the first space A1 (in the third space A3 and the intervening space B) thereby to create negative pressure in the first space A1. On the other hand, the second sucking devices 364 create negative pressure in the second space A2. Specifically, each of the second sucking devices 364 is disposed under the corresponding opening 362*b* in the second space A2. Accordingly, the second sucking devices 364 draw the air in the second space A2 thereby to create negative pressure in the second space A2.

The first sucking device 363 creates in the first space A1 pressure less negative than pressure in the second space A2. Specifically, the air suction force exerted by the one first sucking device 363 is smaller than the air suction force exerted by the two second sucking devices 364. Accordingly, the pressure in the first space A1 (in the third space A3 and the intervening space B) is less negative than the pressure in the second space A2. A plurality of first sucking devices 363 may be included. One, or three or more second sucking devices 364 may be included. The suction force and the number of the first sucking devices 363, and the suction force and the number of the second sucking devices 364 are determined in view of the volume of the first space A1 and the volume of the second space A2 so that the pressure in the first space A1 is less negative than the pressure in the second space A2.

Next, operation of the suction section 360 will be described. Upon actuation of the first sucking device 363 and the second sucking devices 364 with the recording medium P on the conveyance surface of the conveyor belt 355, negative pressure is created in the air flow chamber 362. The negative pressure acts on the recording medium P through the through holes 365 and the grooves 369 of the guide member 361, and the suction holes (not shown) of the conveyor belt 355. Thus, the recording medium P is sucked onto the conveyance surface of the conveyor belt 355. At the same time, the conveyor belt 355 rotates to convey the recording medium P in the conveyance direction D. The pressure in a space above the conveyance surface of the conveyor belt 355 (including a space right under the recording head 390) is atmospheric pressure. Accordingly, the negative pressure created in the air flow chamber 362 sucks the recording medium P onto the conveyance surface of the conveyor belt 355.

[Function of Third Space A3]

A function of the third space A3 of the air flow chamber 362 will be described with reference to FIGS. 1-4. The pressure in the third space A3 overlapping with the recording head 390 (the inkjet heads 390*k*, 390*c*, 390*m*, and 390*y*) is less negative than the pressure in the second space A2. Accordingly, the air flow right under the recording head 390 is restricted.

The third space A3 is configured to overlap with the recording head 390 for the following reason. Negative pressure is created in an air flow chamber of a general suction section. A plurality of grooves and a plurality of through holes are formed in an entire guide member. It is therefore expected that a flow of air into the air flow chamber through the grooves and the through holes conveys a large amount of paper dust from a recording medium from a location upstream of an image formation space in terms of a conveyance direction of the recording medium to the image formation space. The image formation space is between recording head and the guide member. An air flow generated by conveyance of the recording medium in the conveyance direction is also expected to convey paper dust to the image formation space.

The pressure in the air flow chamber of the general suction section is uniform. That is, the general air flow chamber has only a space corresponding to the second space A2 and does not have the partition wall 366 or a space corresponding to the first space A1. Accordingly, the pressure in the air flow chamber is more negative, and the air flow right under the recording head is greater. As a result, it is expected that more paper dust is conveyed close to the recording head and the paper dust is easily blown off (stirred up) right under the recording head. The paper dust may eventually clog nozzles of the recording head. If the nozzles are clogged, an image formed on the recording medium may have a defect.

In the first embodiment, therefore, the pressure in the third space A3 overlapping with the recording head 390 is made less negative than the pressure in the second space A2 next to the third space A3 so that the air flow right under the recording head 390 is restricted. Thus, drawing of paper dust right under the recording head 390 and blowing off of paper dust right under the recording head 390 are restricted. As a result, attachment of paper dust to the recording head 390 is reduced. The reduction of the attachment of paper dust to the recording head 390 permits reduction of possible defects in an image formed on the recording medium P.

The air flow right under the recording head 390 is restricted by making the pressure in the third space A3 less negative. As a result, unintended positional shift and coloristic shift of an image formed on the recording medium P is reduced.

In general, the configuration of the air flow chamber of the suction section is considered a factor that determines the degree of the unintended positional shift and coloristic shift of an image formed on the recording medium. Specifically, the unintended positional shift and coloristic shift of an image is considered dependent on the accuracy of ink landing. The accuracy of ink landing is affected by the air flow in an ink trajectory space (image formation space). If the air flow is fast, the ink trajectory is bent by the air flow. Thus, the configuration of the air flow chamber that has influence on the air flow right under the recording head is considered a factor that determines the accuracy of ink landing, and eventually the degree of the unintended positional shift and coloristic shift of an image.

In the first embodiment, therefore, the accuracy of ink landing is increased by restricting the air flow right under the recording head 390 using the third space A3 overlapping with the recording head 390 in the air flow chamber 362. As a result, the unintended positional shift and coloristic shift of an image is reduced.

Second Embodiment

The conveyor device 300 according to a second embodiment of the present disclosure will be described with reference to FIGS. 1, 5, and 6. The conveyor device 300 according to the second embodiment has the same configuration as the conveyor device 300 according to the first embodiment except that the first space A1 of the air flow chamber 362 of the conveyor device 300 according to the second embodiment includes fourth spaces A4 in addition to the third space A3. The conveyor device 300 according to the second embodiment is mounted in the inkjet recording apparatus 1 shown in FIG. 1 in place of the conveyor device 300 according to the first embodiment, for example. Hereinafter, a difference between the second embodiment and the first embodiment will be mainly described.

Figure 5:
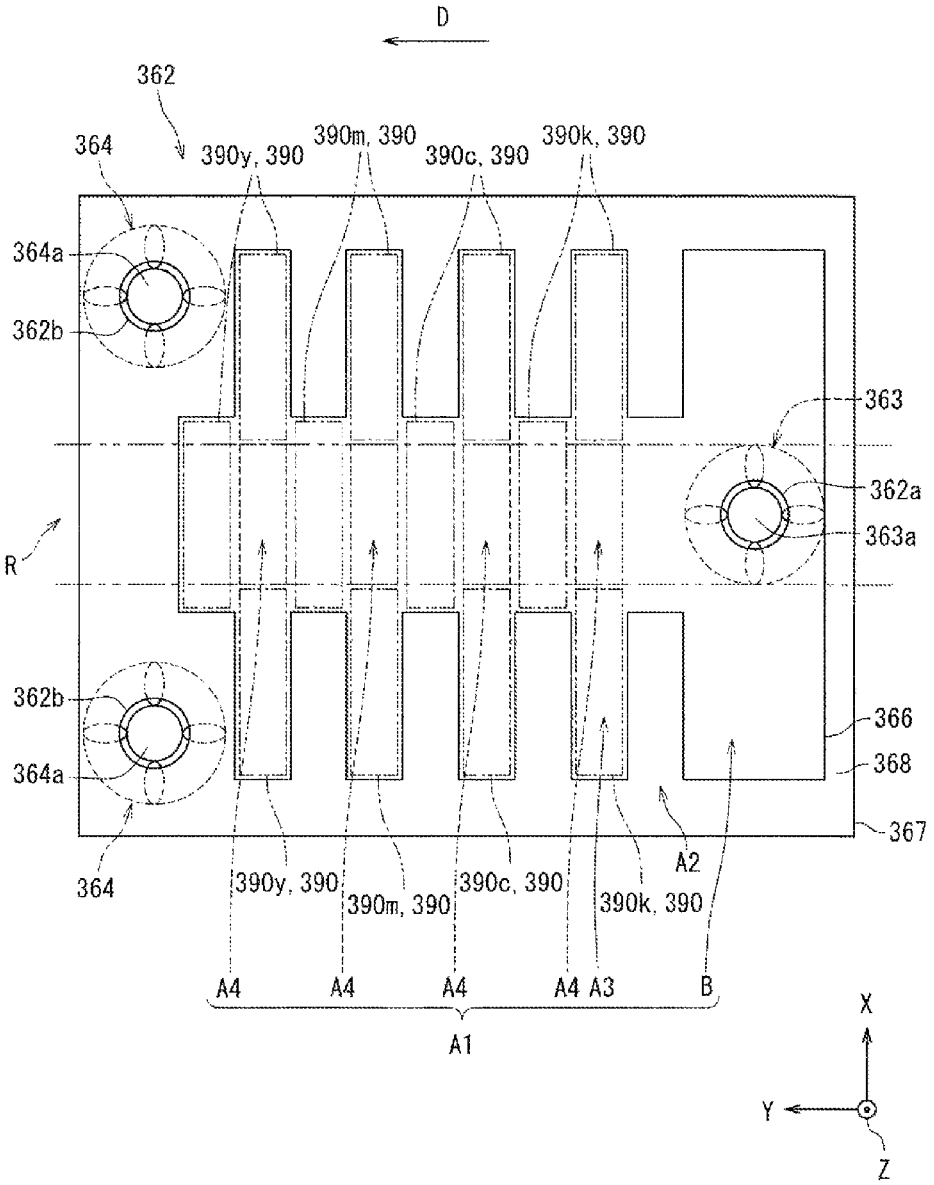
FIG. 5 is a plan view of an air flow chamber of a conveyor device according to a second embodiment of the present disclosure.
Figure 6:
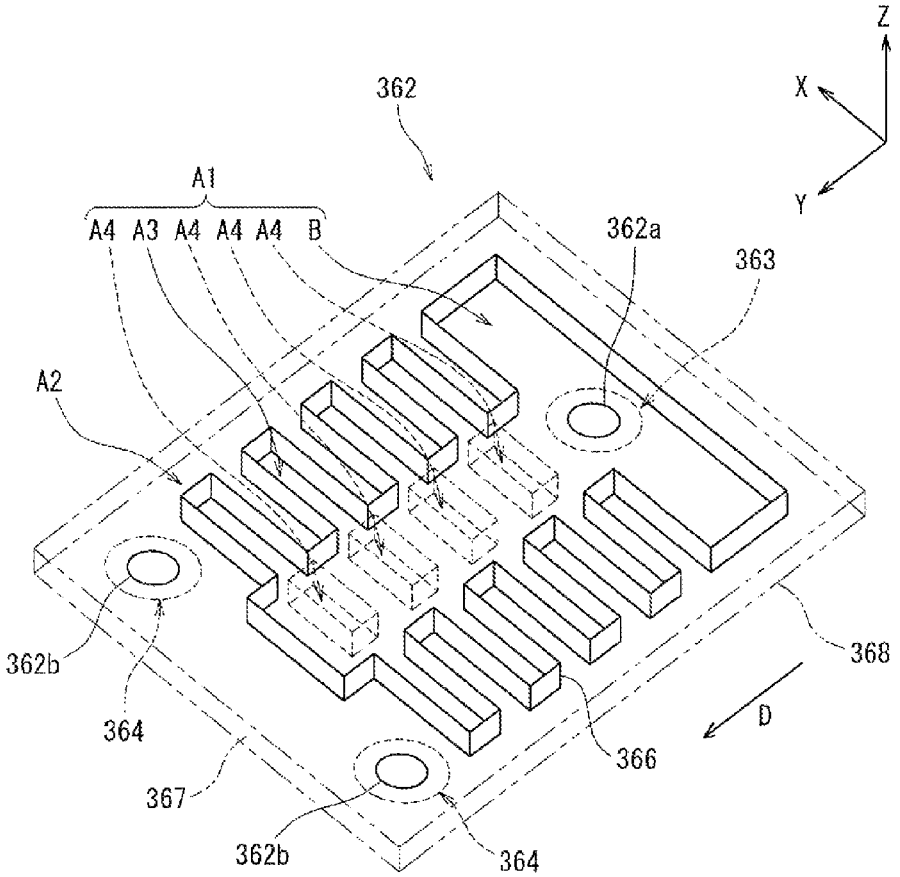
FIG. 6 is a perspective view of the air flow chamber of the conveyor device according to the second embodiment of the present disclosure.

FIGS. 5 and 6 illustrate the air flow chamber 362 of the conveyor device 300 according to the second embodiment. The first space A1 of the air flow chamber 362 further includes a plurality of fourth spaces A4 continuous from the third space A3. A part of the recording medium P that contacts feeding members (hereinafter, referred to as "feeding members F" (see FIG. 1)) passes over the fourth spaces A4. The fourth spaces A4 are aligned in the conveyance direction D. The fourth spaces A4 are represented by dashed lines in FIGS. 5 and 6 for convenience of description, but actually the third space A3 and the fourth spaces A4 are not separated but continuous from the intervening space B.

The position and the width of the fourth spaces A4 will be described in association with the feeding members F and with reference to FIGS. 1 and 5. The feeding members F are included in the conveyor device 300 and convey the recording medium P. The feeding members F include the paper feed roller 312, the pair of first conveyance rollers 313, and the pair of second conveyance rollers 314.

The feeding members F are located upstream of the guide member 361 in terms of the conveyance direction D of the recording medium P. The feeding members F have a smaller width than the width of a smallest possible conveyable recording medium P, for example. The width of each feeding member F is substantially the same as or smaller than the longitudinal dimension of one inkjet head 390*k*, for example. The width of each feeding member F refers to a dimension of each feeding member F that contacts the recording medium P and that is parallel to the rotation axis of each feeding member F. The width of the recording medium P refers to a dimension that is parallel to a direction perpendicular to the conveyance direction D.

As shown in FIG. 5, the plurality of fourth spaces A4 are arranged along a travel path R to be followed by a part of the recording medium P that contacts the feeding members F. The width of the fourth spaces A4 is substantially the same as the width of the feeding members F in the second embodiment. The width of the fourth spaces A4 may be slightly larger than the width of the feeding members F. The width of the fourth spaces A4 refers to a dimension that is parallel to a direction perpendicular to the conveyance direction D.

The feeding members F are disposed so that the recording medium P contacts the feeding members F at a region corresponding to a center line thereof. The center line of the recording medium P herein refers to a center line parallel to the conveyance direction D of the recording medium P. Accordingly, the plurality of fourth spaces A4 are aligned along the conveyance direction D, corresponding to the center line of the recording medium P.

The fourth spaces A4 are disposed in positions corresponding to positions of the feeding members F for the following reason. The paper feed roller 312 skids on a contact surface of the recording medium P when taking out the recording medium P from the paper feed cassette 200. In addition, a sheet of recording medium P being taken out by the paper feed roller 312 and a sheet of recording medium P beneath the recording paper P rub against each other. It is therefore expected that paper dust is likely to be generated in the vicinity of the paper feed roller 312.

The retard roller 313*b* of the pair of first conveyance rollers 313 stops or rotates in a direction opposite to the conveyance direction D of the recording medium P thereby to prevent multiple sheet feeding. It is therefore expected that paper dust is likely to be generated in the vicinity of the pair of first conveyance rollers 313.

The width of the pair of second conveyance rollers 314 is smaller than the width of the recording medium P. Accordingly, each of the pair of second conveyance rollers 314 rotates while edges of each roller are in contact with the recording medium P. The edges of the rollers are relatively sharp. It is therefore expected that paper dust is likely to be generated in the vicinity of the pair of second conveyance rollers 314. The same is true of the paper feed roller 312 and the pair of first conveyance rollers 313.

Next, creation of negative pressure will be described. As shown in FIGS. 5 and 6, the first space A1 is enclosed by the partition wall 366. The first space A1 further includes the intervening space B continuous from the third space A3 and the fourth spaces A4. Negative pressure is created in the first space A1 by the first sucking device 363 disposed under the opening 362*a* as in the case of the first embodiment. Likewise, negative pressure is created in the second space A2 by the second sucking devices 364 through the openings 362*b* as in the case of the first embodiment. Furthermore, the pressure in the first space A1 (in the third space A3, the fourth spaces A4, and the intervening space B) is less negative than the pressure in the second space A2 since the air suction force exerted by the one first sucking device 363 is smaller than the air suction force exerted by the two sucking devices 364 as in the case of the first embodiment.

According to the second embodiment, as described above, the air flow chamber 362 has, in addition to the third space A3, the fourth spaces A4 corresponding to a part of the recording medium P that contacts the feeding members F while traveling and that is likely to generate paper dust. Again, the air suction force exerted by the one first sucking device 363 is smaller than the air suction force exerted by the two second sucking devices 364. Accordingly, not only the pressure in the third space A3 but also the pressure in the fourth spaces A4 is less negative, and thus the air flow is restricted in the space right under the recording head 390 and in the path to be followed by the part of the recording medium P that is likely to generate paper dust. As a result, attachment of paper dust to the recording head 390 is further reduced to further reduce nozzle clogging, preventing a defect in an image formed on the recording medium P.

In addition, according to the second embodiment, the pressure in the second space A2 adjacent to the first space A1 is more negative as in the case of the first embodiment so that suction force sufficient for sucking on the recording medium P is ensured. Furthermore, attachment of paper dust to the inkjet heads 390*k*, 390*c*, 390*m*, and 390*y* in a staggered arrangement can be reduced effectively.

Third Embodiment

The conveyor device 300 according to a third embodiment of the present disclosure will be described with reference to FIGS. 1, 7, and 8. The conveyor device 300 according to the third embodiment has the same configuration as the conveyor device 300 according to the second embodiment except that the partition wall 366 of the conveyor device 300 according to the third embodiment has a different shape from the partition wall 366 of the conveyor device 300 according to the second embodiment. The conveyor device 300 according to the third embodiment is mounted in the inkjet recording apparatus 1 shown in FIG. 1 in place of the conveyor device 300 according to the first embodiment, for example. Hereinafter, a difference between the third embodiment and the second embodiment will be mainly described.

Figure 7:
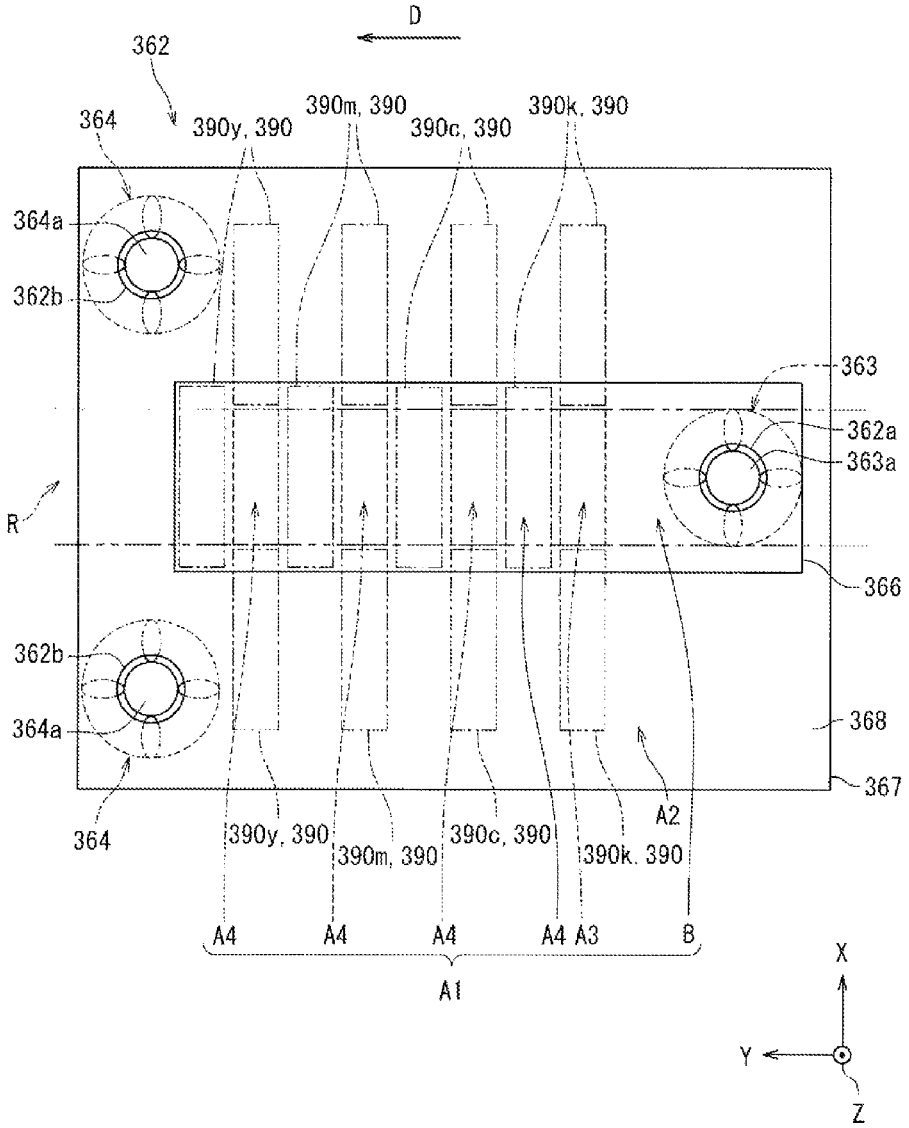
FIG. 7 is a plan view of an air flow chamber of a conveyor device according to a third embodiment of the present disclosure.
Figure 8:
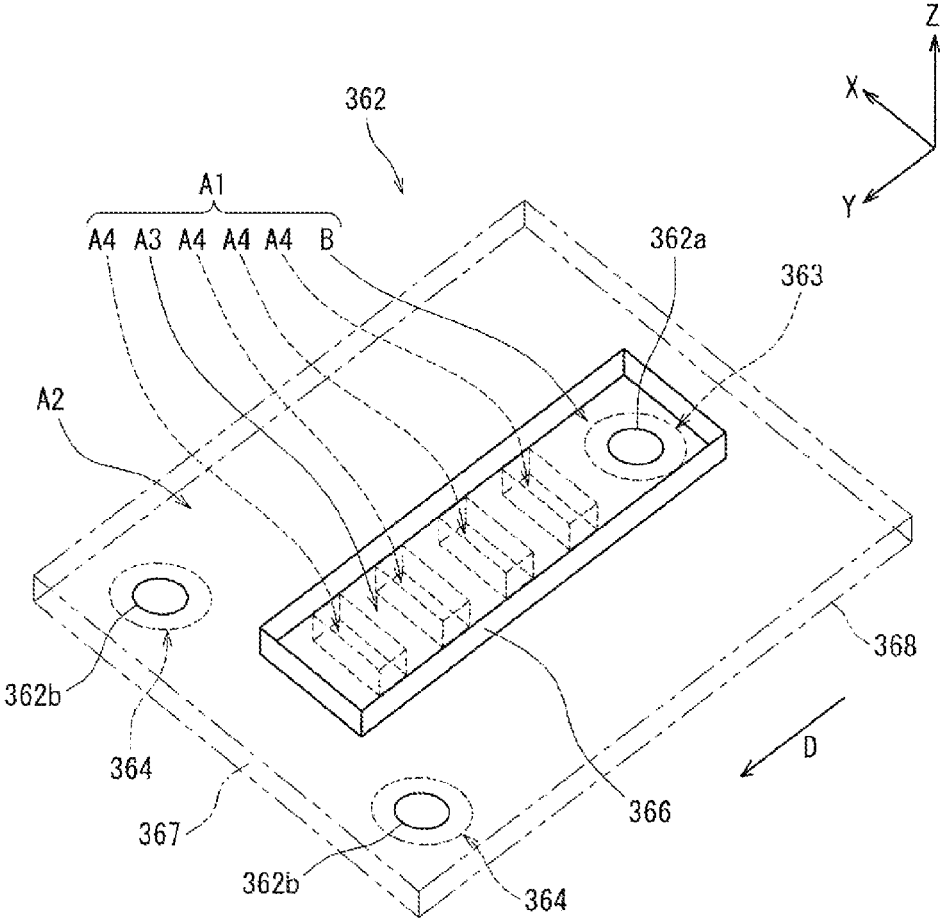
FIG. 8 is a perspective view of the air flow chamber of the conveyor device according to the third embodiment of the present disclosure.

FIGS. 7 and 8 illustrate the air flow chamber 362 of the conveyor device 300 according to the third embodiment. The fourth spaces A4 are represented by dashed lines in FIGS. 7 and 8 for convenience of description, but actually the third space A3 and the fourth spaces A4 are not separated but continuous from the intervening space B.

The partition wall 366 divides the air flow chamber 362 into the first space A1 and the second space A2 along the travel path R to be followed by the part of the recording medium P that contacts the feeding members F. The first space A1 includes the third space A3, the fourth spaces A4, and the intervening space B. Accordingly, the part of the recording medium P that contacts the feeding members F follows a path over the third space A3, the fourth spaces A4, and the intervening space B. The first space A1 is enclosed by the partition wall 366 and has a rectangular shape in a plan view in the third embodiment.

The third space A3 overlaps with the center inkjet head 390*k*, the center inkjet head 390*c*, the center inkjet head 390*m*, and the center inkjet head 390*y* located over the path to be followed by the part of the recording medium P that contacts the feeding members F with the conveyor belt 355 and the guide member 361 therebetween.

Accordingly, the end inkjet heads 390*k* overlap with the second space A2 with the conveyor belt 355 and the guide member 361 therebetween. The same is true of the end inkjet heads 390*c*, the end inkjet heads 390*m*, and the end inkjet heads 390*y*. One end of each of the end inkjet heads 390*k*, the end inkjet heads 390*c*, the end inkjet heads 390*m*, and the end inkjet heads 390*y* overlaps with the third space A3. Alternatively, the partition wall 366 may be formed so that each of the end inkjet heads 390*k*, the end inkjet heads 390*c*, the end inkjet heads 390*m*, and the end inkjet heads 390*y* entirely overlaps with the second space A2. Alternatively, the partition wall 366 may be formed so that each of the center inkjet head 390*k*, the center inkjet head 390*c*, the center inkjet head 390*m*, and the center inkjet head 390*y* partially overlaps with the third space A3.

As in the case of the first embodiment, negative pressure is created in the first space A1 by the first sucking device 363 disposed under the opening 362*a*. Likewise, negative pressure is created in the second space A2 by the second sucking devices 364 through the openings 362*b* as in the case of the first embodiment. Furthermore, the pressure in the first space A1 (in the third space A3, the fourth spaces A4, and the intervening space B) is less negative than the pressure in the second space A2 as in the case of the first embodiment.

According to the third embodiment, as described above, the air flow chamber 362 has the first space A1 (the third space A3 and the fourth spaces A4) as in the case of the second embodiment. As a result, attachment of paper dust to the recording head 390 is reduced, and thus nozzle clogging can be reduced as in the case of the second embodiment.

According to the third embodiment, the partition wall 366 defines the first space A1 along the travel path R. Accordingly, the third space A3 overlaps with the center inkjet heads 390*k*, 390*c*, 390*m*, and 390*y*. In this case, the second space A2 is larger than that in the case where the third space A3 overlaps with all the inkjet heads 390*k*, 390*c*, 390*m*, and 390*y*, and thus the suction force for sucking on the recording medium P can be increased. Meanwhile, the air flow in the path to be followed by the part of the recording medium P that is likely to generate paper dust is restricted by the fourth spaces A4. Thus, attachment of paper dust to the recording head 390 is reduced efficiently.

So far, the embodiments of the present disclosure have been described with reference to the drawings (FIGS. 1-8). However, the present disclosure is not limited to the above-described embodiments and can be practiced in various ways within the scope not departing from the gist of the present disclosure (e.g., the following (1)-(7)). The drawings are intended to illustrate mainly the components in a schematic manner to assist with understanding. The thickness, the length, the number, and so on of each component illustrated are not true to scale for diagrammatic purposes. The shape, the dimension, and so on of each component shown in the above-described embodiments are exemplary only and not particularly limited. Various alternations can be made thereto within the scope not substantially departing from the effect of the present disclosure.

(1) The third space A3 of the air flow chamber 362 overlaps with all the set of inkjet heads 390*k*, the set of inkjet heads 390*c*, the set of inkjet heads 390*m*, and the set of inkjet heads 390*y* according to the description made with reference to FIGS. 2 and 5. Alternatively, the third space A3 of the air flow chamber 362 may overlap with one, two, or three of the set of inkjet heads 390*k*, the set of inkjet heads 390*c*, the set of inkjet heads 390*m*, and the set of inkjet heads 390*y*.

(2) The third space A3 overlaps with the three inkjet heads 390*k* according to the description made with reference to FIGS. 2 and 5. Alternatively, the third space A3 may overlap with one or two of the three inkjet heads 390*k*. The same is true of the other inkjet heads 390*c*, 390*m*, and 390*y*.

(3) The air flow chamber 362 includes the four fourth spaces A4 according the description made with reference to FIGS. 5 and 7. Alternatively, the air flow chamber 362 may include a single fourth space A4, or five or more fourth spaces A4. The fourth spaces A4 are spaces that are included in a space opposite to the travel path R within the first space A1 and that exclude the third space A3. Alternatively, the space opposite to the travel path R within the first space A1 may be entirely defined as a fourth space A4.

(4) The recording head 390 includes the inkjet heads 390*k*, 390*c*, 390*m*, and 390*y* for the four colors according to the description made with reference to FIG. 1. Alternatively, the recording head 390 may include only inkjet heads for a single color or inkjet heads for two, three, or five or more colors. The third space A3 overlaps with the inkjet heads included in the recording head 390.

(5) The three inkjet heads 390*k* are provided for a single color according to the description made with reference to FIG. 2. Alternatively, a single inkjet head 390*k* may be provided for the single color. Alternatively, two, or three or more inkjet heads 390*k* may be provided for the single color. The same is true of the other inkjet heads 390*c*, 390*m*, and 390*y*.

(6) The first space A1 is one continuous space according to the description made with reference to FIGS. 3, 6, and 8. Alternatively, the air flow chamber 362 may be divided to a plurality of first spaces A1 and one or more second spaces A2. In this case, one closed partition wall 366 defines one first space A1, and each of the first space A1 is provided with the first sucking device 363. Likewise, each of the second spaces A2 is provided with the second sucking device 364.

(7) The first space A1 includes a plurality of fourth spaces A4 according to the description made with reference to FIGS. 5 and 6. Alternatively, the first space A1 may include only one fourth space A4.

What is claimed is:

1. A conveyor device that is disposed opposite to a recording head, the conveyor device comprising:

a conveyor belt configured to convey a recording medium; and a suction section configured to suck on the recording medium through the conveyor belt, wherein the suction section includes:

an air flow chamber which is disposed opposite to one surface of the conveyor belt and in which negative pressure for sucking the recording medium onto another surface of the conveyor belt is created; and a guide member configured to cover the air flow chamber and support the recording medium via the conveyor belt, the air flow chamber includes:

a bottom wall;

an outer wall stood from the bottom wall; and a partition wall stood from the bottom wall and surrounded by the outer wall, the partition wall dividing the air flow chamber into at least one first space and at least one second space, the first space includes at least one third space overlapping with the recording head with the conveyor belt and the guide member therebetween, pressure in the first space is less negative than pressure in the second space, the first space is a space enclosed by the partition wall, the second space is a space between the outer wall and the partition wall, the recording head is a linehead, and the line head is fixed.

2. The conveyor device according to claim 1, further comprising a feeding member configured to feed the recording medium, wherein the feeding member is located upstream of the conveyor belt in terms of a conveyance direction of the recording medium, the first space further includes at least one fourth space continuous from the third space, and a part of the recording medium that contacts the feeding member passes over the fourth space.

3. The conveyor device according to claim 2, wherein the part of the recording medium that contacts the feeding member passes over the third space, and the partition wall divides the air flow chamber into the first space and the second space along a travel path to be followed by the part of the recording medium that contacts the feeding member.

4. The conveyor device according to claim 1, wherein the suction section includes:

at least one first sucking device configured to create in the first space pressure less negative than pressure in the second space; and at least one second sucking device configured to create negative pressure in the second space.

5. The conveyor device according to claim 1, wherein the recording head includes a plurality of inkjet heads in a staggered arrangement, and the partition wall divides the air flow chamber such that the third space overlaps with the plurality of inkjet heads with the conveyor belt and the guide member therebetween.

6. The conveyor device according to claim 5, wherein the third space overlaps with a center inkjet head among the plurality of inkjet heads with the conveyor belt and the guide member therebetween, and the second space overlaps with opposite end inkjet heads among the plurality of inkjet heads with the conveyor belt and the guide member therebetween.

7. The conveyor device according to claim 4, wherein the at least one first space is a plurality of first spaces that are each defined by a closed partition wall, and the at least one first sucking device is a plurality of first sucking devices that are each disposed under a corresponding one of the plurality of first spaces.

8. The conveyor device according to claim 4, wherein the air flow chamber is divided into a plurality of first spaces and a plurality of second spaces, the suction section includes a plurality of first sucking devices that are each disposed under a corresponding one of the plurality of first spaces, and the suction section includes a plurality of second sucking devices that are each disposed under a corresponding one of the plurality of second spaces.

9. An inkjet recording apparatus comprising:

the conveyor device according to claim 1; and the recording head, wherein the recording head includes an inkjet head that ejects ink, the inkjet head is a linehead, and the linehead is fixed.

10. The conveyor device according to claim 1, wherein the suction section includes at least one first sucking device configured to create in the first space pressure less negative than pressure in the second space and at least one second sucking device configured to create negative pressure in the second space, and each of the first sucking device and the second sucking device is disposed on the bottom wall and is in communication with the air flow chamber.

11. The conveyor device according to claim 10, wherein the bottom wall has at least one first opening and at least one second opening, the first sucking device is disposed right under the first opening, and the second sucking device is disposed right under the second opening.

12. The conveyor device according to claim 10, wherein the second space does not overlap with the recording head.

13. The conveyor device according to claim 1, wherein the guide member has a plurality of grooves and a plurality of through holes formed throughout the guide member.

14. The conveyor device according to claim 1, further comprising a placing roller configured to convey the recording medium in a conveyance direction of the recording medium while pressing the recording medium against the conveyor belt and the guide member, wherein the placing roller is located at an upstream end of the guide member in terms of the conveyance direction with the conveyor belt therebetween.

* * * * *